United States Patent [19]

Zajac et al.

[11] Patent Number: 4,488,382

[45] Date of Patent: Dec. 18, 1984

[54] KILN RING GRINDING APPARATUS

[75] Inventors: Charles J. Zajac; Allois F. Geiersbach, both of Milwaukee, Wis.

[73] Assignee: Allis-Chalmers Corporation, Milwaukee, Wis.

[21] Appl. No.: 489,704

[22] Filed: Apr. 29, 1983

[51] Int. Cl.[3] ..... B24B 49/08

[52] U.S. Cl. ..... 51/165.92; 51/145 R

[58] Field of Search ..... 51/145 R, 138, 139, 51/165.92, 165.77, 99

[56] References Cited

U.S. PATENT DOCUMENTS

| | | | |
|---|---|---|---|
| 3,466,808 | 9/1969 | Mess | 51/99 |
| 3,524,285 | 8/1970 | Rutt | 51/139 |
| 3,838,541 | 10/1974 | Durst | 51/99 |
| 3,948,001 | 4/1976 | Miyazawa | 51/137 |
| 4,052,822 | 10/1977 | Obear | 51/99 |

*Primary Examiner*—Harold D. Whitehead

*Attorney, Agent, or Firm*—Lee H. Kaiser; Timothy R. Conrad

[57] ABSTRACT

Apparatus for uniformly grinding the peripheral surface of a kiln ring of a rotating rotary kiln to axial flatness includes a grinder; an electrical motor for continually driving the grinder; a pneumatic cylinder for urging the grinder against the surface of the kiln ring; a current transformer for sensing the magnitude of current flow to the motor; and a controller which compares the magnitude of sensed motor current to a set point reference of desired current flow to the motor and supplies pressurized fluid to the pneumatic cylinder at a pressure which varies as an inverse function of the difference between sensed current and set point references and maintains the current flow to the motor equal to the set point reference.

5 Claims, 6 Drawing Figures

CONTROLLER P&I SCHEMATIC

KILN RING GRINDING APPARATUS

BACKGROUND OF THE INVENTION

This invention relates to apparatus of the type disclosed in U.S. Pat. No. 3,466,808 for reconditioning by finishing and "trueing" large diameter, loadbearing circular supports such as the kiln rings, or "tires," which are affixed to and rotatably support rotary kilns and driers used principally in the manufacture of cement.

Tubular rotary kilns commonly of three to four hundred feet in length and ten to twenty or more feet in diameter are used in the manufacture of cement and pulverized lime from limestone and clay. Such long rotary kilns are relatively flexible and have kiln rings, or riding rings affixed thereto of hardened steel machined to close tolerances and several inches thick and several feet in axial length disposed about the periphery of the kiln at spaced distances of forty to sixty feet, for example. The kiln rings are supported and rotate on trunnion roller mountings. Such relatively flexible kilns are heated to high temperatures and continuously rotated over long periods of time and do not necessarily rotate about a fixed central axis since over extended periods of use the kiln rings wear irregularly and may exhibit excessive wear which appears as pitting of the surfaces of the kiln rings or as a deviation of the axial surface from flatness. Replacement of the kiln rings necessitates shutting down the kiln for several weeks with the resulting expensive loss of use of the kiln in addition to the high cost of replacing the kiln rings. In order to avoid deterioration of the kiln rings to the point that they and the trunnion rollers must be replaced, it is common practice to grind the surfaces of the kiln rings until their axial profile is again flat.

Such grinding takes place wile th kiln is in operation and rotating. Both grinding wheels, such as disclosed in U.S. Pat. No. 3,466,808, and grinding belts have been used to recondition the kiln rings. The grinder of prior art apparatus typically was rigidly mounted on a stationary support near the kiln. Usually the kiln ring surface will not follow a uniformly circular path with respect to the stationary grinder. In one instance the kiln ring may wear into an oval profile; in another, the kiln ring may undergo translation movement off of and back onto its supporting trunnion rollers; and in still another, the kiln ring may exhibit large surface profile changes such as bumps, grooves, cavities and flat spots.

In order to maintain uniform grinding, the grinder must be capable of translational movement in a direction radial of the kiln ring to follow changes in the path of the kiln ring surface. Non-uniform grinding could change the circumferential profile of the kiln ring, whereas the grinding is only intended to flatten the axial profile of the ring. Further, inability of the grinder to be translated in a direction radial of the ring in compliance with the surface of the ring could create excessive forces between kiln ring and grinder which might damage ring and/or grinder.

In order to assure compliance of the grinder to the kiln ring surface, it is known in the prior art to use springs to urge the grinder toward the kiln ring. Further, aforementioned U.S. Pat. No. 3,466,898 discloses a combination of mechanical support points on the kiln ring itself together with means permitting limited movement of the grinder relative to the kiln ring while the weight of the grinder is exerted on the kiln ring for the purpose of assuring compliance of the grinder to the kiln ring surface. In such prior art apparatus, control of grinding uniformity is maintained by manual adjustments to the grinder supports to hold a constant grinding pressure.

SUMMARY OF THE INVENTION

It is an object of the invention to provide improved apparatus for uniformly grinding the peripheral surface of a rotating circular member which maintains a constant rate of grinding while still allowing the grinder to move toward and away from the peripheral surface in compliance with change in position of such peripheral surface relative to the grinder or of changes of profile of the peripheral surface.

In accordance with this and other objects of the invention, there is provided a grinder; means including an electrical motor for continually driving the grinder; pneumatic cylinder means for urging the grinder against the peripheral surface of the rotating circular member with a force proportional to the pressure of fluid supplied to the pneumatic cylinder; and means for maintaining the pressure of the fluid within the pneumatic cylinder tending to urge the grinder against the peripheral surface substantially constant regardless of changes of relative position between the peripheral surface and the grinder tending to change the grinding load on the grinder. As external forces such as a raised spot on the kiln ring or translational movement of the kiln ring toward or away from the grinder attempt to change the load on the grinder, the control responds to counteract such tendency by manipulating the fluid pressure within the pneumatic cylinder in a direction to maintain constant grinding load. In a preferred embodiment, means for maintaining the fluid pressure within the pneumatic cylinder substantially constant regardless of external forces tending to change grinder load includes a current transformer for sensing the magnitude of current flow to the motor, means for selectively establishing a set point reference of desired current flow to the motor and pressurized fluid source means for comparing the set point reference to the current sensed by the current transformer and for supplying fluid to the pneumatic cylinder at a pressure which will maintain the current flow to the motor equal to the set point reference.

BRIEF DESCRIPTION OF THE DRAWINGS

The above and other objects and advantages of the invention will be more readily apparent from the following detailed description when considered with the accompanying drawing wherein.

DETAILED DESCRIPTION

Figure 2:
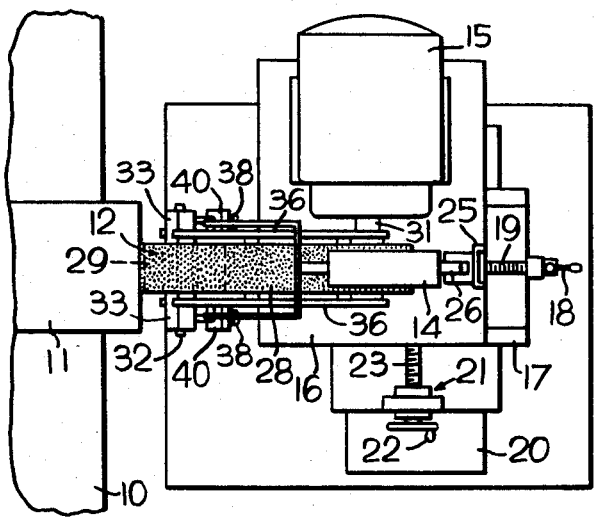
FIG. 2 is a top view of the FIG. 1 apparatus.

The drawings do not disclose the huge size of the rotary kiln 10 and do not show the trunnion rollers which rotatably support it but do illustrate in side view one of the kiln rings 11 which is affixed to the kiln 10 and is rotatably supported upon such trunnion rollers as kiln ring 11 is being reconditioned by a belt grinder 12 while the rotary kiln 10 is in operation. As described hereinbefore, such tubular rotary kilns 10 are commonly of three to four hundred feet in length and ten to twenty or more feet in diameter and are relatively flexible and the kiln rings 11 affixed thereto are of hardened steel several inches thick and several feet in axial length disposed about the periphery of the kiln 10 at spaced distances of forty to sixty feet, for example. Such relatively flexible rotary kilns 10 may be lined with refractory brick 13 and heated to high temperature and continuously rotated over long periods of time and do not necessarily rotate about a fixed central axis since over extended periods of use the kiln rings 11 wear irregularly and may exhibit excessive wear which appears as pitting of the peripheral surface of the ring 11 or as a deviation of its axial surface from flatness.

Figure 1:
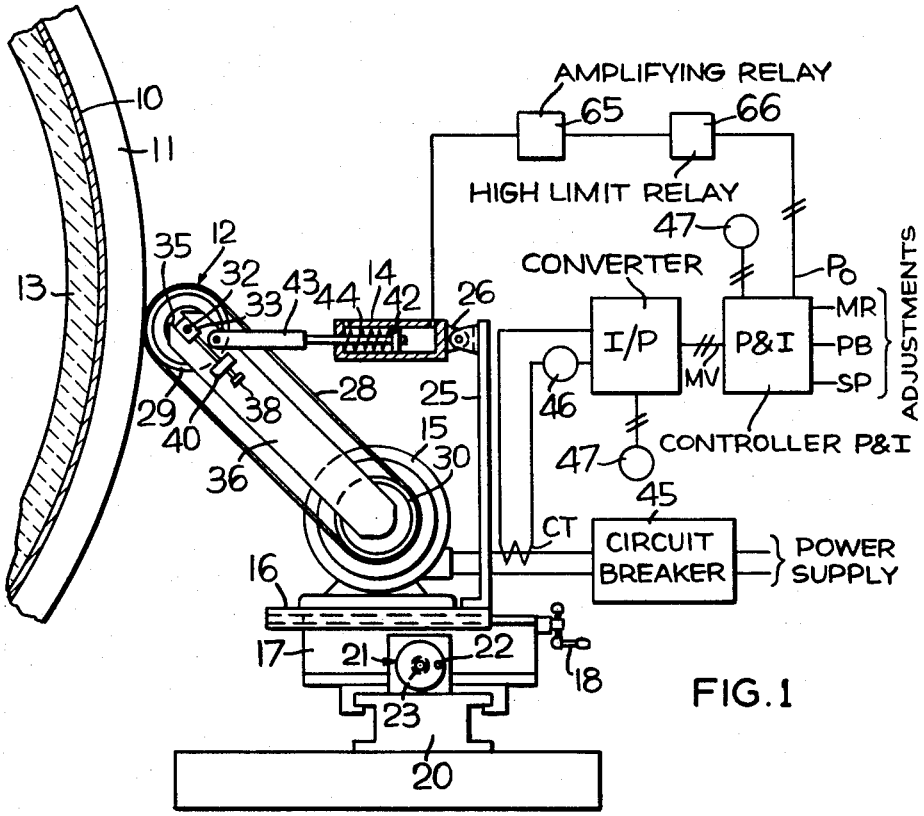
FIG. 1 is a side view of kiln ring, grinder, and grinder motor which schematically illustrates a preferred embodiment of the invention having a pneumatic cylinder for maintaining the grinder in compliance with the kiln ring surface and means for maintaining the pneumatic cylinder pressure substantially constant regardless of changes in grinding load to thereby assure uniform grinding of the kiln ring surface.

Our invention achieves compliance of the belt grinder 12 to the surface of the kiln ring 11 by means of a pneumatic cylinder 14 to produce the force required to urge grinder 12 against the peripheral surface of the kiln ring 11 and cause uniform grinding as belt grinder 12 is continuously driven by a grinding motor 15, preferably of the electric type. Pneumatic cylinder 14 is shown in FIG. 1 as a single-ended cylinder wherein pneumatic pressure is applied to only one fixed end of the cylinder casing and the other end is vented to the atmosphere. Cylinder 14 may be mounted on an upper slide carriage 16 which is dovetailed on a lower slide carriage 17 to permit translational movement of upper carriage 16 carrying grinder 12 toward and away from kiln ring 11 by, for example, turning of handle 18 which rotates a feed screw 19. Lower slide carriage 17 is dovetailed on a stationary bed member 20 to permit movement of lower and upper carriages 16 and 17 carrying motor 15 and grinder 12 parallel to the axis of kiln ring 11. Means 21 are provided for moving grinder 12 parallel to the axis of, and back and forth across, the peripheral surface of kiln ring 11 while grinder 12 is conditioning such peripheral surface, and such means is illustrated in FIGS. 1 and 2 as a manual handle 22 for rotating a feed screw 23 which engages lower carriage 17. Such means 21 for moving the grinder 12 axially of the kiln ring may comprise a computer controlled drive (not shown) of the type for operating an automatic lathe so that the cutting tool moves back and forth across the surface of the work object.

An upright member 25 mounted on upper carriage 16 has affixed adjacent its upper end a horizontal support arm 26 which is pivotally connected to one end of pneumatic cylinder 14 to permit movement of grinder 12 toward and away from kiln ring 11 in compliance with the kiln ring peripheral surface and to maintain uniformity of grinding of such surface.

It is schematically represented in the drawing that grinder 12 includes an abrasive belt 28 which encircles an upper driven idler drum 29 and a lower driving drum 30 secured to the shaft 31 of grinding motor 15. Upper driven idler drum 29 is journalled on an axle shaft 32 whose ends are rotatable within a pair of shaft support blocks 33 disposed on opposite sides of drum 29. Blocks 33 are slidable within grooves 35 provided adjacent the upper end of a pair of inclined support plates 36 that are disposed on opposite sides of drums 29 and 30 and pivotally mounted at their lower end on motor shaft 31. Belt tensioning adjusting bolts 38 engage internally threaded members 40 affixed to support plates 36, and the ends of bolts 38 bear against slidable blocks 33 so that turning of adjusting bolts 38 increases or decreases the distance between driving drum 30 and idler drum 29, and thus changes the tension in belt 28.

One end of the piston 42 of pneumatic cylinder 14 is attached to a yoke 43 having bifurcated portions secured to support plates 36 on opposite sides of idler drum 29 so that movement of piston 42 can actuate upper drum 29 carrying abrasive belt 28 toward and away from kiln ring 11 as pressure is increased and decreased, respectively, within cylinder 14 to thereby actuate piston 42 to the left and the right as seen in FIG. 1. A return spring 44 disposed within the casing of cylinder 14 reacts at one end against the cylinder casing and at the other end against piston 42 to return the piston and withdraw belt 28 in a direction away from kiln ring 11 when pressure is lowered within pneumatic cylinder 14. It will be readily apparent that return spring 44 can be external of the cylinder casing and that the fluid pressure with cylinder 14, and the resulting force exerted by piston 42, must be sufficiently high to deflect return spring 44 and force belt 28 against the peripheral surface of kiln ring 11.

Pneumatic cylinder 14 preferably is compatible with the normal 3–15 psig pneumatic control range. Inasmuch as the air within pneumatic cylinder 14 is compressible, movement of kiln ring 11 toward grinder 12 can move the grinder 12, including belt 28 and driven drum 29, to the right as seen in FIG. 1 without causing high mechanical forces on grinder 12 or the kiln ring 11. The only result of such movement of kiln ring 11 toward or away from grinder 12 is that the pressure within pneumatic cylinder 14 increases or decreases from its set point value. If kiln ring 11 does move relative to grinder 12 and changes the pressure within pneumatic cylinder 14, grinder 12 will engage kiln ring 11 with more or less than the desired force and in prior art apparatus would not grind ring 11 at a uniform rate. Our invention prevents such non-uniform grinding by cylinder pressure control means which regulates the pressure within pneumatic cylinder 14 as a function of the magnitude of current to grinding motor 15. Stated in another way, our invention includes pneumatic cylinder input pressure control means which varies the pressure within cylinder 14 so as to maintain the motor current at a constant value.

For example, if kiln ring 11 moves toward grinder 12, it will force driven drum 29 and piston 42 to the right as seen in FIG. 1, thereby compressing the air in cylinder 14 and raising its pressure. Such increased pressure will increase the force of grinder 12 against the surface of kiln ring 11, thereby increasing the grinding rate and drawing higher current to grinder motor 15. The cylinder input pressure control means of the invention senses that the motor current is above the set point value and automatically reduces pressure within cylinder 14 until the motor current, and hence the grinding rate, is again at the set value. On the other hand, if kiln ring 11 moves away from grinder 12, the cylinder pressure control means automatically increases the pressure within cylinder 14 to maintain uniform motor current and a uniform grinding rate of kiln ring 11.

Figure 4:
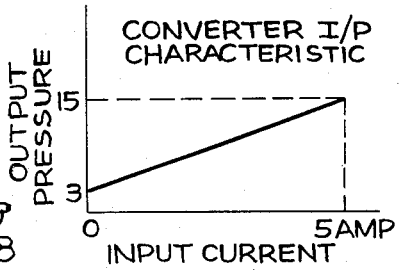
FIG. 4 is a graph plotting sensed motor current input to converter I/P versus output pneumatic pressure.

Current from an electric power line flows through a circuit breaker 45 to motor 15 and the magnitude thereof is sensed by a current transformer CT and is an input through an optional ammeter 46 to a current-to-pressure converter I/P. Converter I/P also has an input from a constant pressure compressed air supply 47, e.g., 20 psig, and produces an output pneumatic pressure on fluid line MV shown in FIG. 4 ranging from 3 to 15 psig as the motor input current sensed by current transformer CT changes over the range from zero to five amperes rms. Current transformer CT may have a standard five ampere secondary and its primary current rating will be determined by the range of motor current with sufficiently wide operating limits to handle inrush starting current to motor 15.

Grinder 12 may alternatively be a grinding wheel. Further, grinding belt 28 need not be driven directly by an electric motor 15, but rather could be driven by a hydraulic motor (not shown) or an air motor. In such alternative embodiments, current transformer CT could sense the current to the electric motor which drives the hydraulic pump supplying the hydraulic or the air motor. Alternatively, current sensing could be changed to pressure sensing in the hydraulic motor power hose since, given constant hydraulic flow, pressure sensing would measure grinder power.

The pneumatic pressure output from converter I/P is an input (over a fluid line designated ≠) to the measured variable MV input of a controller P&I which also has a 20 psig compressed air supply input 47. Controller P&I may be a Moore 55 Controller commercially available from Moore Products Company of Spring House, Pa. The compressed air output $P_o$ from controller P&I is fed over a fluid line (also designated by the symbol ≠) to pneumatic cylinder 14 and is in a direction to change the pressure to pneumatic cylinder 14 until the current to motor 15 is at the set point value, and hence the grinding rate is at the desired value.

Figure 5:
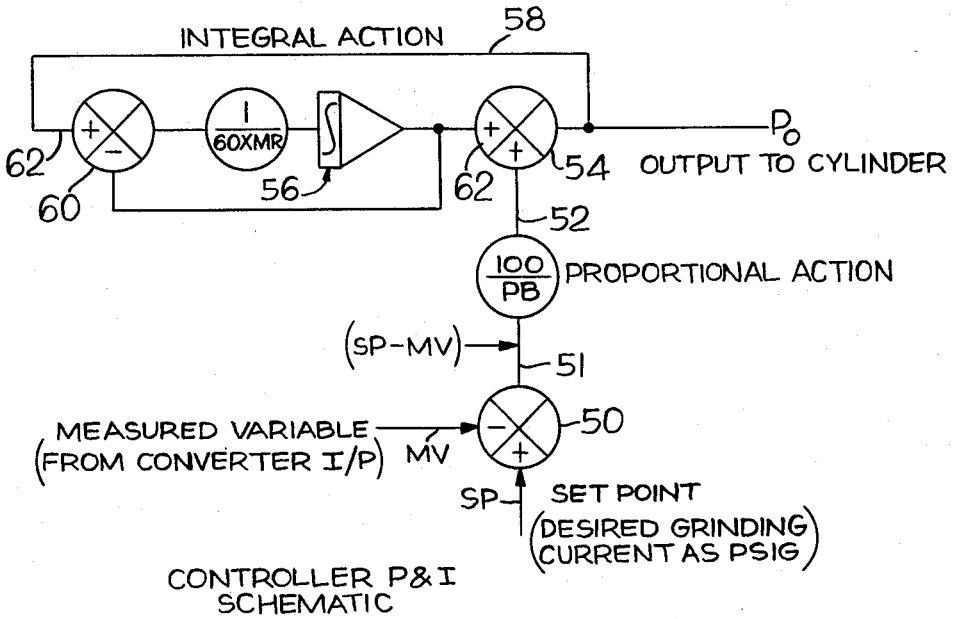
FIG. 5 is a schematic representation of the pressure and current controller which receives as one input the output from converter I/P that is proportional to the magnitude of sensed grinding motor current and as a reference input the set point desired motor current and supplies as an output pressurized air to the pneumatic cylinder at a pressure which is a function the difference between the sensed current and set point reference inputs to maintain motor current at the set point value.

The schematic circuit of controller P&I is shown in FIG. 5 and its operation follows the classic controller equation:

$$\text{Output } P_o = \frac{100}{PB}\left\{ (SP - MV) + \frac{1}{60MR} \int (SP - MV)dt \right\}$$

The pneumatic signal from converter I/P (which is proportional to measured motor current) serves as the measured variable fed into the MV(−) input of summing junction 50 of controller P&I, which controller also receives three other adjustment inputs, namely:

(1) SP=set point and is the desired motor current expressed in psig fed into a second (+) input of summing junction 50 so that the output thereof on line 51 is proportional to (SP−MV). This set point adjustment SP establishes a reference pressure against which the MV input pressure is measured;

(2) PB=proportional band (dial setting) and is the "proportional band" adjustment on the controller expressed as percent of the linear range. For example, if the linear range is from 3–15 psig, or 12 psig total, a 10% PB setting would require a 1.2 psig input change on lead MV to cause a full range output swing $P_o$ of 12 psig. The output (SP−MV) from summing junction 50 appearing on line 51 is an input to a gain setting constant multiplier designated 100/PB which performs the 100/PB{(SP−MV)} multiplication function appearing on line 52 which is applied to a (+) input of summing junction 54. As long as (SP−MV) does not equal zero, a non-zero signal will pass through element 100/PB. If an abrupt change in measured variable MV occurs, it passes directly through summing junction 54 to output $P_o$ leading to pneumatic cylinder 14 and also applies an input over line 58 to summing junction 60 of integrator section 56, and the integrator section 56 continues to function until the signal applied to input 62 of summing junction 54 is equal to output $P_o$; and (3) MR=minutes per reset (dial marking) and is the minutes per reset adjustment of the integrator section 56 of controller P&I (0.1 seconds minimum). This is equivalent to a time constant of 60×MR seconds. The integrator section 56 of the controller P&I which calculates the ∫(SP−MV) dt equation continually changes the pneumatic pressure output $P_o$ as long as SP and MV are unequal; i.e., until (SP−MV)=0, thus forcing equality of the measured value MV (motor current) to set point SP (desired grinder motor current) through the feedback loop (comprising cylinder 14 and motor 15) to within component tolerances and yielding zero error. This is in contrast to a simple linear amplifier which would have a finite error proportional to gain. It should be noted that the "proportional" action 100/PB{(SP−MV)} is not subject to the integrator time constant, thus permitting fast corrective action.

If MV (sensed motor current) is higher than SP, controller P&I will reduce its output pressure $P_o$, which ultimately reduces pressure in pneumatic cylinder 14. This reduces grinding force and motor current until MV and SP are equal. In order to initially set SP, ammeter 36 is observed while grinding and SP is adjusted until ammeter 36 shows that motor current is at the desired value (SP) by automatic action of the controller P&I as it adjusts pneumatic cylinder pressure in the proper direction.

A step increase in the measured variable MV (motor current) produces a step decrease in output pressure $P_o$ according to $$P_o = 100/PB\{(SP-MV)\}$$

Integral action occurs with a time constant, adjusting output pressure $P_o$ from controller P&I until MV=SP again.

The pneumatic components of the disclosed embodiment are supplied from a 20 psig compressed air source 47 and have a normal operating range of 3–15 psig. Pneumatic cylinder 14 typically operates at higher pressure (up to 60 psig), and consequently amplifying relay 65 may be inserted between controller P&I and pneumatic cylinder 14. A high limit relay 66 may be inserted between controller P&I and pneumatic cylinder 14 to limit the final signal pressure to 15 psig, since in some cases controller P&I output $P_o$ can reach the full 20 psig supply value.

Figure 3:
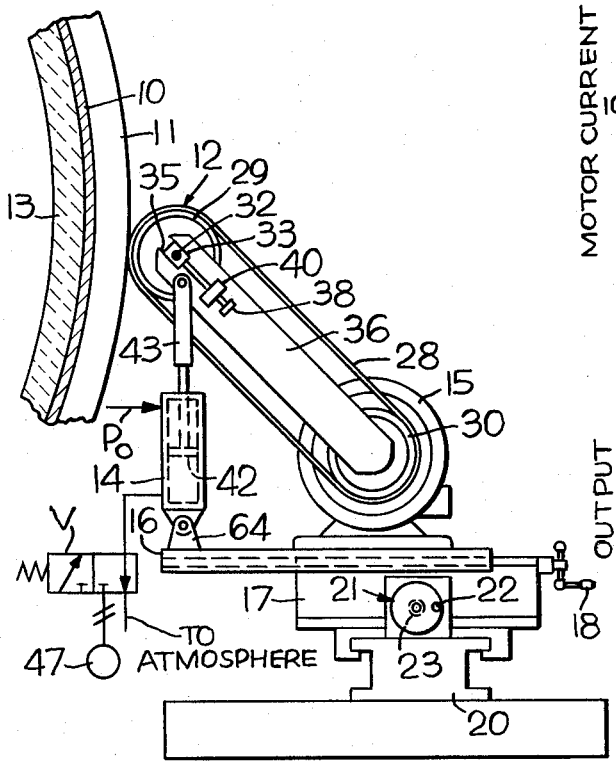
FIG. 3 is a side view of an alternative embodiment of the invention wherein the pneumatic cylinder pulls downward on the grinder to maintain it in compliance with the kiln ring surface.
Figure 6:
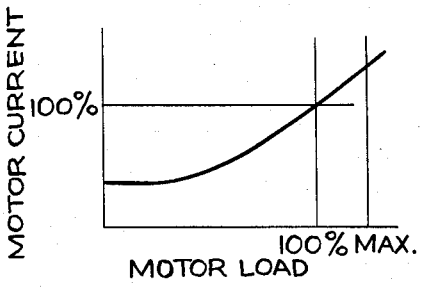
FIG. 6 is a graph plotting motor current versus motor load.

FIG. 3 illustrates an alternative embodiment wherein pneumatic cylinder 14 pulls down on grinder 12 to urge it into grinding engagement with kiln ring 11. The lower end of pneumatic cylinder 14 is pivotally connected to an upwardly projecting member 64 on upper carriage 16. During normal operation $P_o$ from controller P&I is supplied between piston 42 and the upper end of cylinder 14 while the lower end of cylinder 14 is vented through a two-way valve V to the atmosphere. Valve V is actuated to its alternative position to connect the lower end of cylinder 14 to constant pressurized fluid supply source 47 when it is desired to raise grinder 12 and cease grinding.

The embodiments of the invention in which an exclusive property or privilege is claimed are defined as follows:

1. An apparatus for grinding the peripheral surface of a rotary circular member comprising:

a grinder;

means including an electrical motor for continually driving said grinder;

means for sensing the magnitude of current flowing to said motor;

pneumatic cylinder means for urging said grinder against said peripheral surface with a force proportional to pressure of fluid supplied to said pneumatic cylinder;

means for generating a first fluid flow at a pressure which is a function of the sensed magnitude of current flowing to said motor;

means for selectively establishing a second fluid flow having a pressure proportional to a desired current flow to said motor;

means for comparing said pressures of said first and second flows and providing a flow of fluid to said pneumatic cylinder at a pressure which will force said grinder against said surface at force sufficient for said sensed current flow to equal said desired current flow.

2. An apparatus according to claim 1 comprising a current transformer for sensing the magnitude of said current flowing to said motor;

a current-to-pressure converter for generating said first fluid flow;

a controller which receives as a measured variable input the output fluid from said converter that is proportional to the magnitude of said sensed motor current and also receives as a reference input pressurized fluid from a source which is adjustable to a reference set point magnitude proportional to desired current flow to said motor, and said controller includes means for comparing said measured variable and reference inputs and providing fluid to said pneumatic cylinder at a pressure which will maintain said current sensed by said current transformer equal to said reference set point magnitude.

3. An apparatus according to claim 2 comprising:

a belt grinder having a driving drum;

a driven drum and means for connecting said driven and driving drums in spaced parallel relation;

an abrasive grinding belt operably encircling said drums;

means for securing said driving drum to a support structure with said driving drum operable to rotate and rotate said belt about said drums and with said driven drum pivotal about said driving drum sufficient to move said abrasive grinding belt against a peripheral surface of a rotating circular member;

means including an electric motor for continually rotating said driving drum;

said pneumatic cylinder having a first end connected to said support structure and a second end connected to said driven drum and having a fluid input for receiving pressurized fluid from said controller with said cylinder urging said driven drum against said peripheral surface.

4. An apparatus according to claim 3 comprising means for moving said support structure in a direction parallel to the axis of said rotating circular member.

5. An apparatus according to claim 4 wherein said controller is a proportional-integral controller.

* * * * *